US005265698A

United States Patent [19]

Friedel, Jr.

[11] Patent Number: 5,265,698

[45] Date of Patent: Nov. 30, 1993

[54] SELF-LEVELING LADDER

[76] Inventor: Warren Friedel, Jr., 26 Periwinkle Rd., Levittown, N.Y. 11756

[21] Appl. No.: 800,971

[22] Filed: Dec. 2, 1991

[51] Int. Cl.[5] ..... E06C 1/00

[52] U.S. Cl. ..... 182/201; 182/204

[58] Field of Search ..... 182/201, 202, 203, 204

[56] References Cited

U.S. PATENT DOCUMENTS

| | | | |
|---|---|---|---|
| 349,666 | 9/1886 | Rowland et al. | 182/201 |
| 1,312,725 | 8/1919 | Gagnier | 182/201 |
| 1,323,227 | 11/1919 | Kirby | 182/201 |
| 1,346,831 | 7/1920 | Lehmann | 182/201 |
| 1,491,642 | 4/1924 | Swain | 182/201 |
| 1,568,201 | 1/1926 | Allen | 182/201 |
| 2,129,401 | 9/1938 | Botinger | 182/201 |
| 2,306,797 | 12/1942 | Biery | 182/201 |
| 2,481,581 | 9/1949 | Ehnhuus | 182/201 |
| 4,676,342 | 6/1987 | Godde | 182/201 |

*Primary Examiner*—Karen J. Chotkowski
*Attorney, Agent, or Firm*—Bucknam and Archer

[57] ABSTRACT

An extendable stepladder has a pair of front legs and a pair of rear legs (10), first steps for connecting the front legs together and second steps for connecting the rear legs together. A slider (12) which is telescopically arranged on the outer surface of each leg has a cut-out portion (18) thus forming a vertical passage along each leg. The knob (22) is capable of sliding upwardly and downwardly along the cut-out portion. Each slider has a bracket (19) which has an opening (20). When the sliders of the front legs or the rear legs are extended to a length greater than the length of the rear legs or the front legs respectively, the ladder is firmly secured by means of a bolt (24) which is received in an opening in the front and rear legs. Further, a female T-bolt (30) having four prongs (32), and an internally threaded shaft (34) the shaft having a proximal end and an opposite end is provided. The bolt (24) is inserted into the proximal end of the shaft (34) and the prongs are held between each of the legs and each of the shafts (34) and a tension knob shaft (60) is inserted through the opposite end of the shaft (34) whereby full locking compression is achieved.

4 Claims, 5 Drawing Sheets

FIG. 5
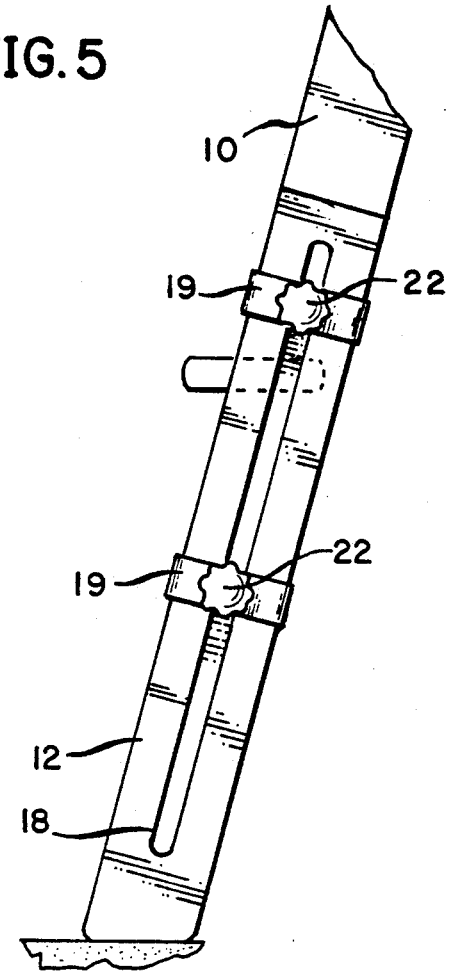
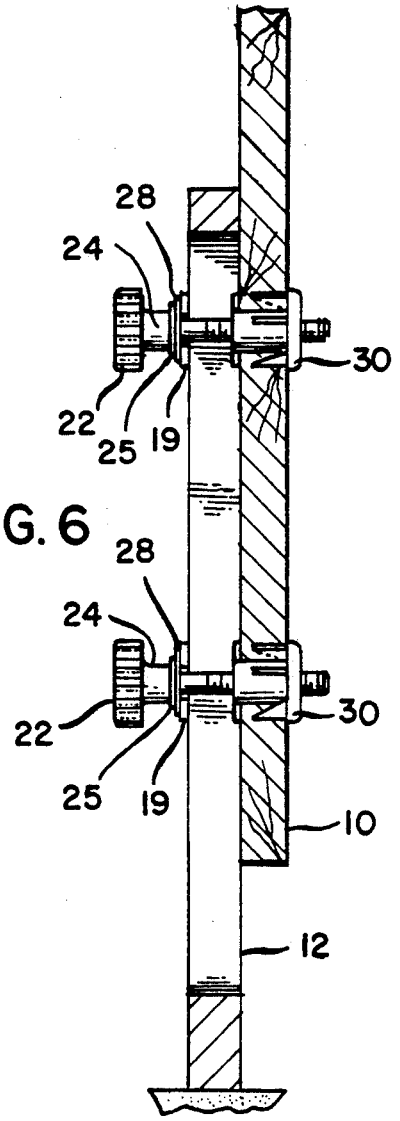
FIG. 6
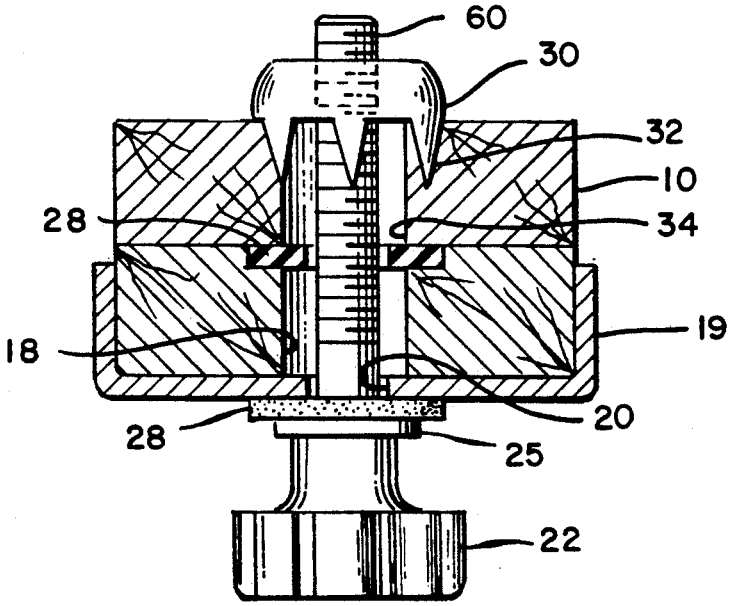
FIG. 7

SELF-LEVELING LADDER

The present invention relates to a self-leveling ladder, that is a ladder which may adjust itself to uneven ground surfaces or may be used in a stairway.

BACKGROUND OF THE INVENTION

Extendible stepladders are needed for use on stairway, on any inclined surface, for instance, a sloping driveway. It is also necessary to provide a safe stepladder so that the workman will not be exposed to falls and serious injury.

Many proposals of self-leveling ladders have been made. U.S. Pat. No. 2,481,581 which issued in 1949 describes a device which may be applied to either the front or back legs to vary the length of any one of the four legs. According to this patent, in order to extend or lengthen the front leg structure at the lower end of each of the front legs or sides, a guide channel is provided which is long enough to constitute a sleeve. This sleeve is shaped in cross section to present a side portion and edge flanges in opposed relation to firmly fit the side and the edges of the legs. The channels are held in place by screws to provide a passage through which is mounted for sliding movement an extension member so that it can be manually moved up and down for adjustment beyond the end of the leg to extend the ladder structure at the front. The sleeve has fastened an internally threaded nut which is aligned with a similar opening in the sleeve to receive a threaded end of an adjusting handle. The handle is manipulated to jam the extension piece in a desired position. Similar sleeves and extension members are provided for the rear legs. The drawback with this extendible stepladder is that it is not sufficiently stable because the extension members are only held on one side of the legs of the ladder.

Another proposal has been made in U.S. Pat. No. 4,676,342 which describes a tressle with rails consisting of a hollow tube within which is disposed a telescoping extension. The rails have openings and there are bolts and spring plates for securing the extension member to the leg. The possibility that the extension member will slip out with substantial injury to the workman also exists because only one lock system is used. Also the legs of this tressle are very thin and the disc used is not sufficiently firm.

SUMMARY OF THE INVENTION

An object of the present invention is to provide a stepladder which may be safely used on two, three and even four different levels and which is completely safe even at seven feet.

Another object is to provide a stepladder which is safe in use and may be easily adjusted to any desired height.

Still another object of this invention is to provide a stepladder which is economical to manufacture.

The crux of the present invention resides in a stepladder which has a superior locking device. The device comprises a bolt having a male thread adapted to enter an opening in the slider and an opening in the leg and engageable with a female T-bolt. In addition, the locking device comprises rubber compression washers so that the slider is locked in place by compression on both sides.

BRIEF DESCRIPTION OF THE DRAWINGS

The invention is illustrated by reference to the accompanying drawings of which:

FIG. 5 illustrates one end of the locking device;

FIG. 6 shows the end of the locking device opposite to the end shown in FIG. 5;

FIG. 7 is a cross-section of the locking device when assembled;

Figure 1:
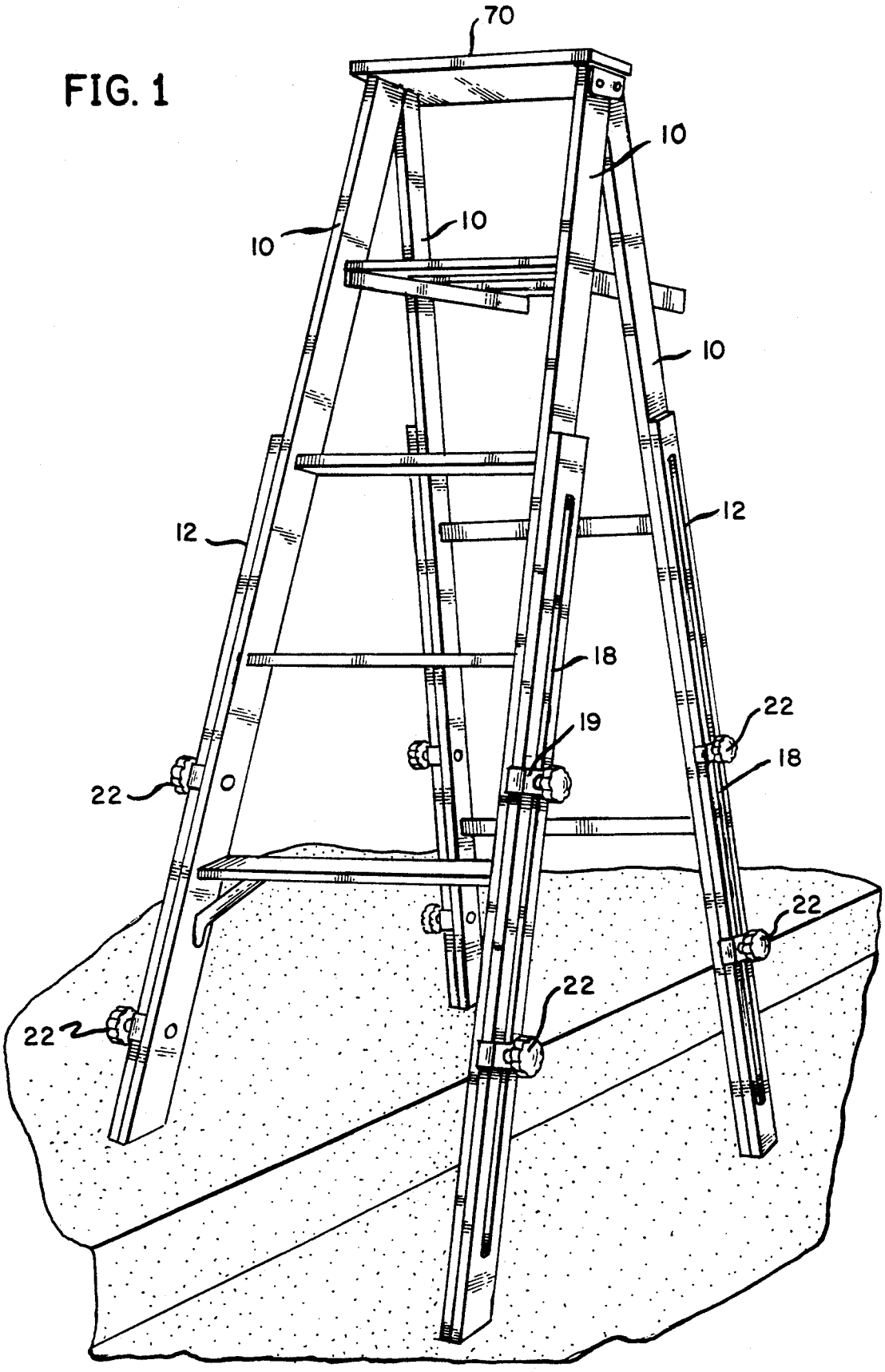
FIG. 1 is a perspective view of the stepladder of the invention.

By reference to the Figures, the stepladder has four legs 10 which are of equal size and preferably of a diameter of about $1\frac{3}{4}$–$2\frac{1}{4}$ inches, that is about one inch larger than in a conventional stepladder. Numeral 70 designates the top support or platform. Each leg 10 is provided with a slider 12 which is telescopically arranged on the outer surface of the leg. The sliders are provided with bolts which have heads or knobs 22, preferably made of 0.20–0.35 inch steel plate. Each bolt is threaded for engagement with a T-nut female thread 40 placed in the leg 10 of the stepladder.

Figure 4:
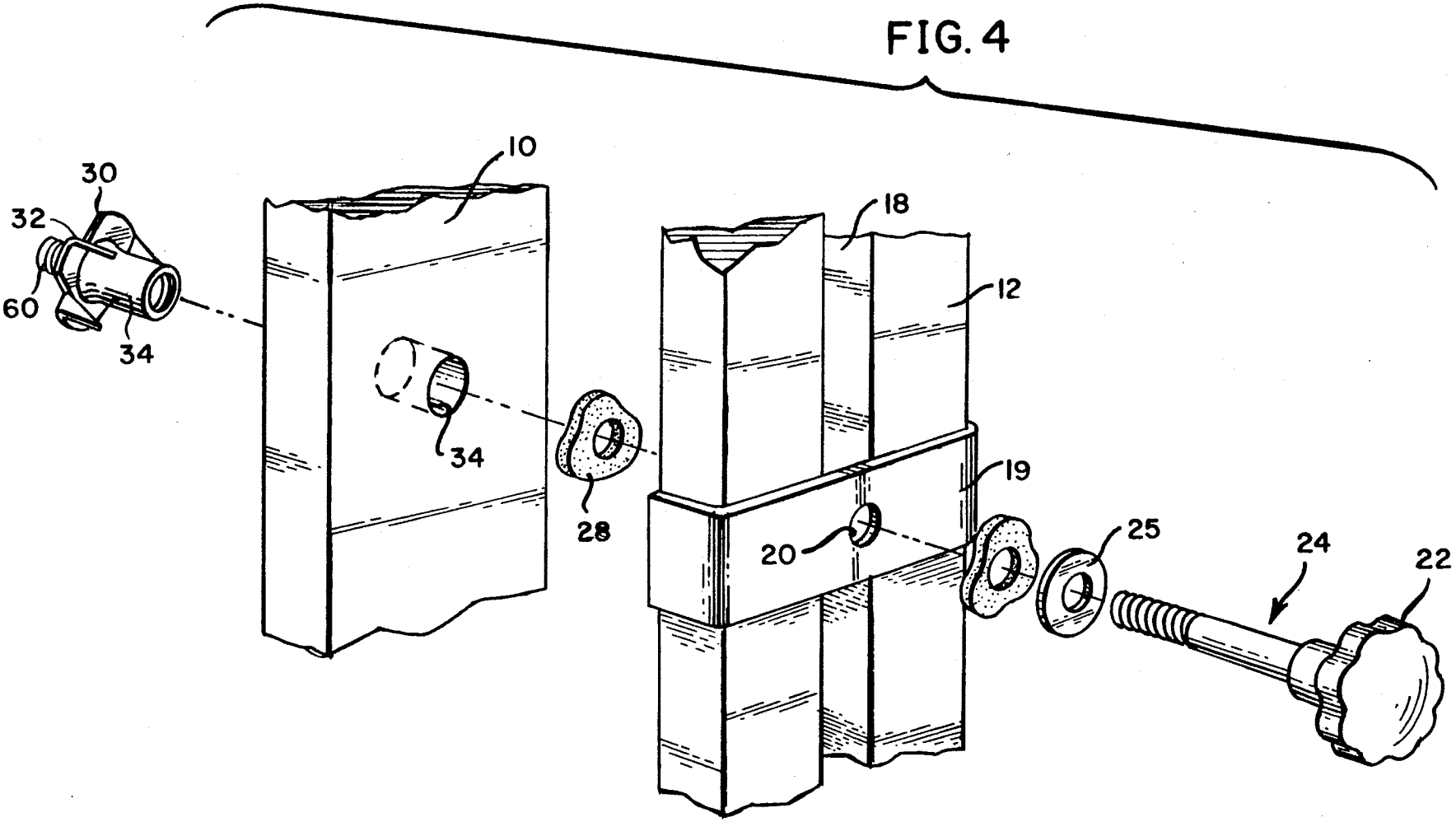
FIG. 4 is a perspective view of the locking device used to hold the legs in the extended position.
Figure 8:
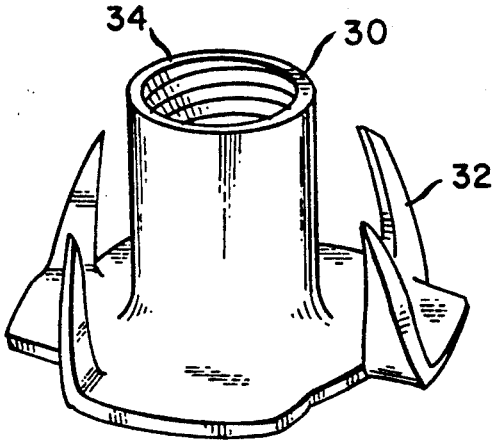
FIG. 8 is an elevational view of a female T-bolt with four groups.
Figure 9:
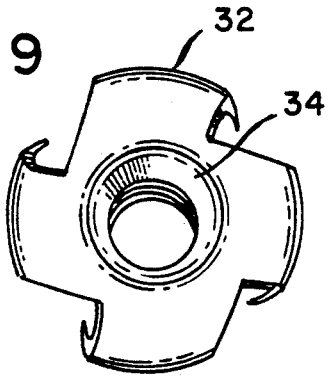
FIG. 9 is a plan view of the base of the female T-bolt of FIG. 8.
Figure 10:
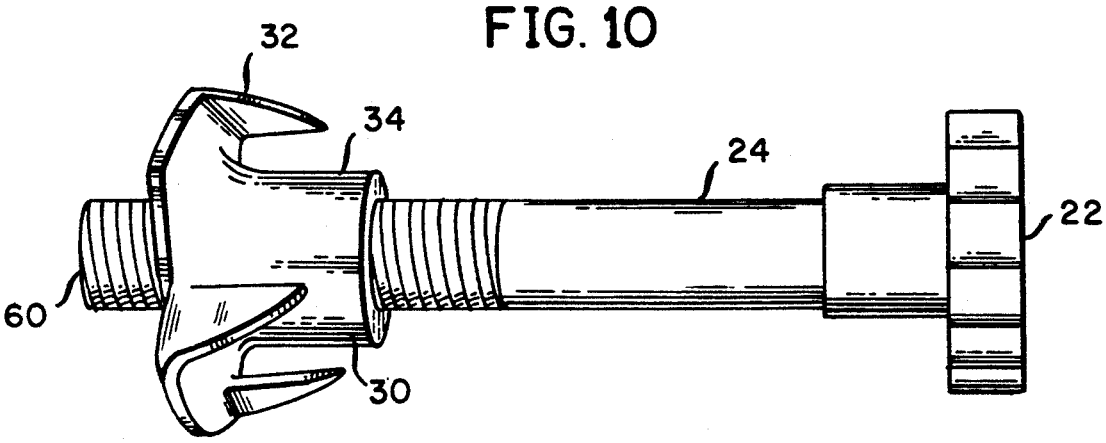
FIG. 10 is a side view of the assembled device shown in FIG. 7 in cross section.

As shown in FIG. 4, each slider has a cut-out 18 which is preferably 0.25–0.40 inch so that the knob may slide up and down along the leg 10. Numeral 19 designates a bracket on the slider. The bracket has an opening 20. The bracket which is preferably made of 3/16–$\frac{5}{8}$ inch steel plate wraps about three-quarters of the slider. The opening 20 is about 5/16–7/16 inch and is drilled in the center of the bracket.

As shown in FIG. 4, at one end the locking device according to the present invention comprises bolt 24, steel washer 26, and washer 28. This washer 28 is a rubber compression washer made from a 3/16–5/16 inch rubber. The leg has an opening 40 as shown in FIG. 7 for letting the bolt go through.

At the opposite end, the locking device has a female T-bolt 30 which is provided with four prongs 32 made of 0.20–0.30 inch stainless steel. Numeral 34 is the shaft made of 0.60–0.80 inch steel. This shaft is internally threaded and goes through the opening 40 drilled in two legs. When the stepladder is extended, shaft 34 goes through openings 40 and 20 and bolt 24 engages with the T-bolt 30 in such a manner that the prongs 32 remain firmly held between the leg and the shaft 34. Numeral 60 designates a tension knob shaft inserted through the shaft 34 and screwed into it. When the ladder is extended and locked in position, the tension knob shaft penetrates through the base of the female T-bolt so that full locking compression is achieved.

Figure 2:
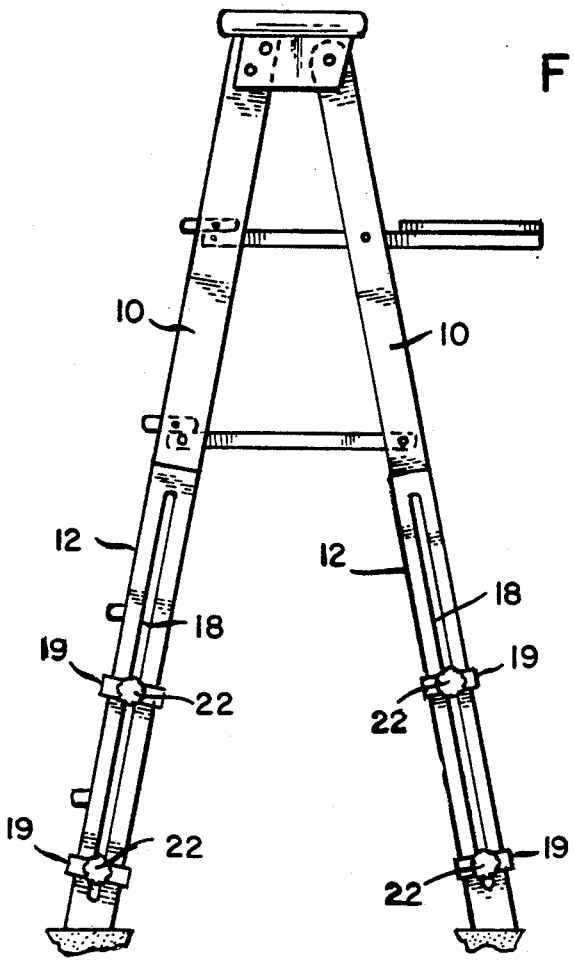
FIG. 2 is a side view of the ladder in the normal unextended position.
Figure 3:
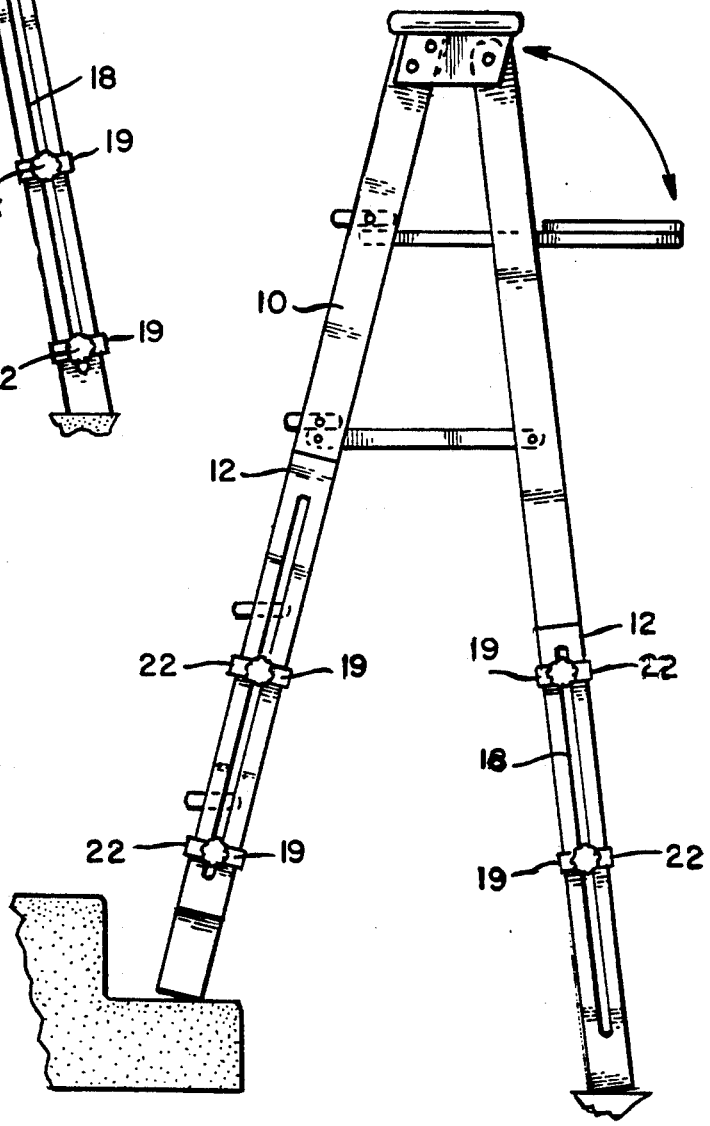
FIG. 3 is a side view of the ladder in the extended position.

Preferably two locking devices are used for increased safety when the stepladder is extended, as shown in FIGS. 1, 2 and 3. One locking device is located at a height of about 6 inches from the bottom and the other is arranged at a height of about 18 inches from the bottom.

What is claimed is:

1. An extendible stepladder having a pair of front legs and a pair of rear legs (10), first steps for connecting the front legs together and second steps for connecting the rear legs together, a horizontal platform (70) at the top supporting said front legs and said rear legs, a slider (12) telescopically arranged on the outer surface of each leg, each of said sliders having a cut-out portion (18) thus forming a vertical passage along each leg, and a knob (22) capable of sliding upwardly and downwardly along said cut-out portion, each slider having a bracket (19), each of said brackets wrapping about three-quarters of each of said sliders, each of said brackets having a first opening (20), at least one locking means for firmly securing the ladder when the sliders of the front legs or the rear legs are extended to a length greater than the length of the rear legs or the front legs respectively, said locking means comprising a threaded bolt (24), each of said front and rear legs having a second opening (40) for receiving said bolt (24), each of said second openings being aligned with each of said first openings, a female T-bolt (30) having four prongs (32), and an internally threaded shaft (34), said shaft having a proximal end and an opposite end, said bolt (24) being inserted into said proximal end of said shaft (34) when the sliders of the front legs or the rear legs are in the extended position, said prongs being held between each of said legs and each of said shafts (34), a tension knob shaft (60) inserted through said opposite end of said shaft (34) whereby full locking compression is achieved, and the ladder further comprises a steel washer (26) and a rubber compression washer (28) interposed between said knob (22) and said slider.

2. The stepladder according to claim 1 wherein a tension knob shaft (60) is inserted through said shaft (34) and is screwed into therein, whereby when the ladder is extended and locked in position, said tension knob shaft (60) penetrates through the base of said female T-bolt.

3. The ladder according to claim 1 wherein said legs have a diameter of about $1\frac{3}{4}$–$2\frac{1}{4}$ inches.

4. The ladder according to claim 1 which comprises first locking means located at about 6 inches from the bottom and a second locking means at a height of about 18 inches from the bottom.

* * * * *